US011998043B2

(12) United States Patent
Hagen

(10) Patent No.: US 11,998,043 B2
(45) Date of Patent: Jun. 4, 2024

(54) WATER PIPE WITH VALVELESS SUCTION TUBE

(71) Applicant: AIR IP HOLDINGS LIMITED, Dubai (AE)

(72) Inventor: Klaus Hagen, Haren (DE)

(73) Assignee: AIR IP HOLDINGS LIMITED, Dubai (AE)

( * ) Notice: Subject to any disclaimer, the term of this patent is extended or adjusted under 35 U.S.C. 154(b) by 525 days.

(21) Appl. No.: 17/271,877

(22) PCT Filed: Aug. 29, 2018

(86) PCT No.: PCT/DE2018/100740

§ 371 (c)(1),
(2) Date: Feb. 26, 2021

(87) PCT Pub. No.: WO2020/043224

PCT Pub. Date: Mar. 5, 2020

(65) Prior Publication Data

US 2021/0259305 A1 Aug. 26, 2021

(51) Int. Cl.
*A24F 1/30* (2006.01)
*A24F 40/10* (2020.01)

(52) U.S. Cl.
CPC ..... *A24F 1/30* (2013.01); *A24F 40/10* (2020.01)

(58) Field of Classification Search
CPC ..... A24F 1/30
USPC ..... 131/329
See application file for complete search history.

(56) References Cited

U.S. PATENT DOCUMENTS 2,815,030 A * 12/1957 Wenger ..... A24F 1/30 131/213
3,889,690 A * 6/1975 Guarnieri ..... A24F 1/30 131/330
3,918,464 A 11/1975 Kolodziej
4,029,109 A 6/1977 Kahler
4,031,906 A * 6/1977 Knapp ..... A24F 1/30 131/173
4,133,318 A 1/1979 Gross
4,253,475 A * 3/1981 Schreiber ..... A24F 1/30 131/173

(Continued)

FOREIGN PATENT DOCUMENTS

CN 202276825 U 6/2012
CN 104055225 A 9/2014

(Continued)

*Primary Examiner* — Peter G Leigh
(74) *Attorney, Agent, or Firm* — Hayes Soloway P.C.

(57) ABSTRACT

The invention relates to a water pipe with a multi-part housing (2) for smoking accessories, an electronic system, and a liquid medium (12), wherein the housing part (3) that receives the liquid medium (12) has at least one suction connection (5) and is connected to the housing part (4) that receives the heating chamber (31) and to a capsule (13) that receives the smoking medium via a suction tube (11) that passes through a housing part (7) which receives the electronic system. The suction tube (11) has a closure unit (10) in the region of the transition between the housing part (7) that has the electronic system and the housing part (3) that receives the liquid medium. The closure unit (10) is designed as a suction tube (11) end piece (38) bent in a U-shape.

12 Claims, 4 Drawing Sheets

(56) References Cited

U.S. PATENT DOCUMENTS

| | | | | |
|---|---|---|---|---|
| 5,738,116 | A * | 4/1998 | Truelove | A24F 1/30 131/195 |
| 7,775,218 | B2 | 8/2010 | Shraiber | |
| 9,027,565 | B2 * | 5/2015 | Wagenhals | A61M 11/041 128/200.11 |
| 9,820,511 | B2 * | 11/2017 | Shen | A24F 40/485 |
| 2004/0234699 | A1 | 11/2004 | Hale et al. | |
| 2005/0279371 | A1 * | 12/2005 | Billard | A24F 1/30 131/185 |
| 2006/0086364 | A1 | 4/2006 | Liu | |
| 2007/0144514 | A1 | 6/2007 | Yeates et al. | |
| 2009/0151717 | A1 | 6/2009 | Bowen et al. | |
| 2010/0126516 | A1 | 5/2010 | Yomtov et al. | |
| 2010/0263681 | A1 | 10/2010 | Zhao | |
| 2011/0186060 | A1 | 8/2011 | Saleh | |
| 2012/0000478 | A1 * | 1/2012 | Wagenhals | A61M 11/041 131/329 |
| 2012/0042884 | A1 | 2/2012 | Mukaddam | |
| 2012/0067357 | A1 | 3/2012 | Boutros et al. | |
| 2012/0199572 | A1 | 8/2012 | Shen et al. | |
| 2014/0060554 | A1 | 3/2014 | Collett et al. | |
| 2014/0069446 | A1 | 3/2014 | Haddad | |
| 2014/0230832 | A1 | 8/2014 | Saliman | |
| 2015/0053221 | A1 | 2/2015 | Asghar-Sheikh et al. | |
| 2016/0066619 | A1 | 3/2016 | DiCarlo | |
| 2016/0206001 | A1 | 7/2016 | Eng et al. | |
| 2016/0235122 | A1 | 8/2016 | Krietzman | |
| 2017/0080545 | A1 | 3/2017 | Furusawa et al. | |
| 2017/0099873 | A1 | 4/2017 | Benjamignan et al. | |
| 2017/0251718 | A1 | 9/2017 | Armoush et al. | |
| 2018/0103683 | A1 | 4/2018 | Parker | |
| 2018/0271150 | A1 | 9/2018 | Sparklin et al. | |
| 2018/0317544 | A1 * | 11/2018 | Hagen | A24F 1/30 |

FOREIGN PATENT DOCUMENTS

| | | | | |
|---|---|---|---|---|
| CN | 104522890 | A | 4/2015 | |
| CN | 105876857 | A * | 8/2016 | A24F 1/30 |
| CN | 205922873 | U * | 2/2017 | |
| DE | 498312 | | 5/1930 | |
| DE | 20004134 | U1 | 5/2000 | |
| DE | 20205060 | U1 | 8/2002 | |
| DE | 202005015795 | U1 | 1/2006 | |
| DE | 102014005884 | A1 | 10/2015 | |
| DE | 202016104296 | U1 | 8/2016 | |
| DE | 102015121435 | A1 | 5/2017 | |
| DE | 102015121435 | A1 * | 5/2017 | A24F 1/30 |
| EP | 2422633 | A1 | 2/2012 | |
| FR | 3019989 | | 10/2015 | |
| GB | 2553773 | A | 3/2018 | |
| WO | 2013057185 | A1 | 4/2013 | |
| WO | 2014012216 | A1 | 1/2014 | |
| WO | 2015172224 | A1 | 11/2015 | |
| WO | WO-2015172224 | A1 * | 11/2015 | A24F 1/30 |
| WO | 2017080545 | A1 | 5/2017 | |

* cited by examiner

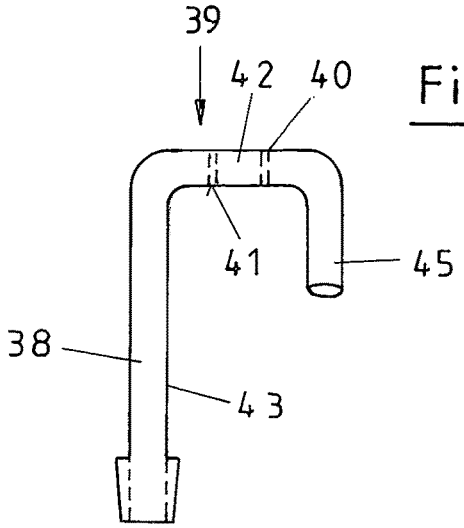
Fig.4
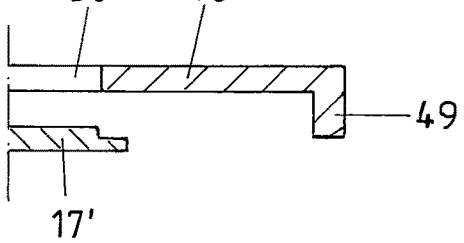
Fig.5
Fig.6
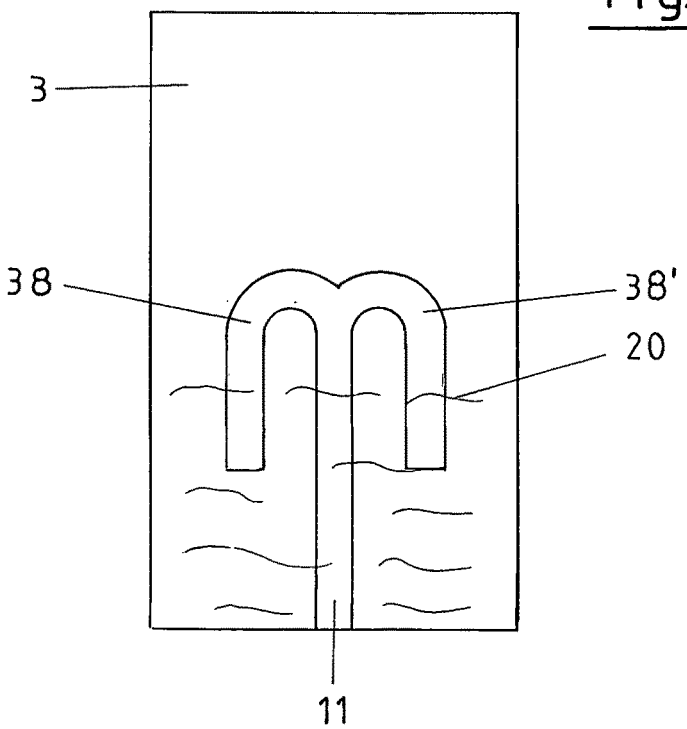

WATER PIPE WITH VALVELESS SUCTION TUBE

CROSS-REFERENCE TO RELATED APPLICATIONS AND PRIORITY

This patent application claims priority from PCT Patent Application No. PCT/DE2018/100740 filed Aug. 29, 2018. This patent application is herein incorporated by reference in its entirety.

The invention relates to a waterpipe with a multi-part housing for the smoking accessories, the electronic system and a liquid medium, wherein the housing part that holds the liquid medium has at least one suction port and is connected, via a suction tube passing through a housing part that holds the electronic system, to the housing part that holds the heating chamber and to a capsule that holds the smoking medium, and wherein the suction tube has a closure unit in the region of the transition from the housing part having the electronic system to the housing part that holds the liquid medium.

Waterpipes, also known as shishas or hookahs, originated in the Orient. They have become increasingly popular in recent years, especially among young people and adolescents, not least as an alternative to cigarettes. Such waterpipes are known, inter alia, from U.S. Pat. No. 4,031,906 and US 2012/0042884. Such a waterpipe comprises a container that is to be partially filled with water or another liquid medium. By sucking on a mouthpiece, a reduced pressure is created in this container. A smoking column projects a certain distance into the water, with a head at its upper end to hold tobacco, which is heated with charcoal lying thereon. The mixture of air, steam and smoke particles produced when the tobacco is heated is then drawn in by the smoker. Obviously, due to the heating by glowing charcoal, carbon monoxide poisoning, burns injuries, or, in extreme cases, even the outbreak of fire can occur. Such classic waterpipes are also known from US 2014/0069446. Furthermore, for shishas, as a result of manual filling, the assembly of waterpipes in accordance with legal requirements is often not guaranteed. In principle, currently known shishas should therefore only be operated outdoors or in rooms with a guaranteed supply of fresh air. Shishas according to this state of the art are also relatively heavy and bulky, have to be assembled from several parts and their individual components are difficult to transport. Cleaning is also laborious and often does not meet current hygiene standards. From, for example, U.S. Pat. No. 4,133,318, so-called electronic shishas are known, with which some of the above-mentioned problems can be reduced, but usually not in a satisfactory way. Shishas known from WO 2017/080545 have also proven to be particularly advantageous. However, there are still shortcomings in the prior art due to the leakage of air in the region of the connection between the water tank and the housing of the shishas. This transition out of the container proves to be a kind of predetermined breaking point, with corresponding negative effects in relation to handling and smoking experience. From DE 10 2015 121 435.0, a shisha is known in which the housing with the capsule and a heating coil is accommodated in the lower part of the housing, while the container with the liquid medium, usually water, forms the upper part of the overall housing. The electronic unit with switch etc is arranged in between. This particular arrangement has the advantage that the smoke produced in the base region rises as it were automatically through the suction tube and reaches the region of the liquid medium. When the waterpipe is put into action, the smoke can enter the upper container due to the reduced pressure therein and flow through the water towards the suction port. A non-return valve is arranged in the base region of the upper container with the liquid medium, to prevent liquid entering the suction tube. The disadvantage is that this valve, which is located in the base region of the upper container, presents a certain resistance to draught, so that the smoke can only flow into the upper container containing the liquid medium once corresponding suction force has been applied.

The invention is based on the objective of reducing the resistance to draught when smoking a waterpipe to as low an order of magnitude as possible.

The objective is achieved according to the invention in that the closure unit is formed as an end piece of the suction tube that is bent into a U-shape.

In the embodiment of the waterpipe according to the invention, having a closure unit formed as an end piece of the suction tube bent into a U-shape, the suction tube may be formed with its bend reaching the water surface. This means that there is no need for a valve requiring a high suction force or a corresponding closure unit, so that, advantageously, after the reduced pressure has been generated in the upper container with the liquid medium, the smoke effectively enters the liquid in small bubbles and rises in it, releasing harmful substances into the liquid medium, i.e. the water. The fine bubbles result in a considerably larger surface area of the smoke bubbles, and thus a better "cleaning" of the smoke.

For the sake of simplicity, in the following the housing part that holds the liquid medium is referred to as the upper container, the housing part that holds the electronic system is referred to as the middle container and the housing part that holds the heating chamber is referred to as the lower container. Other positions of the housing parts in relation to each other are also conceivable.

Furthermore, it is important that the suction tube and the water level are matched with each other, in that the suction tube is formed with its bend reaching just below the water surface, or the operator must ensure that the water level takes up this arrangement relative to the bend.

According to an expedient embodiment of the invention, it is provided that the end piece is releasably connected to the suction tube that ends in the region of the base of the housing part that holds the liquid medium. The modified closure unit, i.e. the end piece of the smoking tube that is bent into a U-shape, thus represents a separate unit which is connected to the suction tube when the waterpipe is assembled, which can easily be done by means of O-rings and similar sealing units in such a way that no leaks occur in this part of the waterpipe. The separation of end piece and customary suction tube also has advantages, above all because both parts can then be cleaned more easily and quickly.

The end piece bent into a U-shape has a particularly advantageous form if the free end of the end piece is first bent at a right angle parallel to the water surface and then again at a right angle towards the base of the upper container. This reliably prevents ingress of the liquid medium into the end piece and then into the suction tube. Instead, it is automatically held back before reaching the part running parallel to the water surface.

Handling of this end piece is improved, particularly during assembly, if the part of the end piece running parallel to the water surface has an aid to turning. As a rule, a flattening of this section serves as an aid to turning, so that this component can be held with a tool similar to pliers.

In order to reliably prevent the "overflow" of the liquid medium into the suction tube, the invention provides that the vertical part of the end piece reaches approximately to the middle of the upper container and the free part that points towards the base of the housing part that holds the liquid medium has up to one third of the overall length of the end piece. During filling of the liquid medium, it should be ensured that the end piece is always covered by the liquid medium.

As mentioned, the waterpipe consists of three parts, whereby the upper container holds the liquid medium, so that sealing problems can occur here, which is prevented according to the invention by a sealing ring being arranged between the base of the upper container and the upper edge of the middle container.

In the prior art, upper and middle containers, i.e. the upper container partially filled with the liquid medium and the middle container holding the electronic system are to be connected to each other via a thread. According to the invention, it is proposed that the upper and middle containers are formed with a click fastening so that the connection can be made more quickly.

The necessary stability of the waterpipe is improved by the lower container being equipped with a baseplate that has a significantly larger diameter than the lower container, preferably twice as large a diameter. This not only improves the stability, but this baseplate can also fulfil other functions, such as, for example, securement of the mouthpiece of the suction hose or similar additional parts of a waterpipe.

According to an expedient development, it is provided that the baseplate has a lower edge serving as a standing aid and a recess in the centre, which is dimensioned to allow passage of the capsule in both directions and is equipped with a closure plate for insertion from below. This makes it possible to push the capsule out of the heating chamber after use with known means, the closure plate either being removed beforehand or being pushed out together with the capsule. Since the base plate has a lower edge, there is a space in which the capsule can initially remain until it has cooled down somewhat. Of course, it is also possible to lift the waterpipe together with the baseplate, in order to dispose of the hot capsule and insert a new capsule, and then position it in the heating chamber with the closure plate.

Flavoured tobacco is also smoked in many different flavours, especially in Europe. The best-known flavour is probably the so-called double apple, as well as cherry-mint, orange-lemon, mango-vanilla, banana-cappuccino, caramel-licorice, coconut-multifruit, red grape-strawberry, peach-melon and cola. The tobacco industry likes to constantly create new and unusual flavours, so that, for example, basil or beer tobacco are now available. In order to make it clear which tobacco is currently in the waterpipe, the invention provides that the end piece bent into a U-shape is coloured to indicate a particular smoking medium and/or a capsule that contains this smoking medium, and that the upper container is made of transparent material or is equipped with corresponding viewing slits. This makes it easy for the consumer to see which tobacco he is being offered and can then decide whether he wants to smoke this or another.

That the closure unit comprises a plurality of end pieces of the suction tube bent into a U-shape, i.e. that the suction tube opens into a similar plurality of end pieces which are matched to each other in such a way that the suction tube with its bend reaches to just below the water surface, reflects a further alternative embodiment of the invention.

The invention is characterised in particular by the fact that by dispensing with the closure unit formed as a valve, the resistance to draught in operation of the waterpipe may be considerably reduced, so that the smoker achieves, even with a reduced suction power, that the smoke generated by the heating coil and the capsule rises into the upper container with the liquid medium and enters the liquid medium in fine bubbles and can then flow further in the direction of the suction port. In addition to the reduced resistance to draught, a significantly improved "cleaning" of the smoke or vapour is also achieved. The overall result is enjoyment when smoking such a waterpipe that is much better and less hazardous to health.

Further details and advantages of the subject-matter of the invention will be apparent from the following description of the accompanying drawing, in which a preferred exemplary embodiment is illustrated with the necessary details and components:

FIG. 4 shows, on an enlarged scale, the end piece of the suction tube,

FIG. 5 shows a partial section through the baseplate of the lower container and FIG. 6 shows an outline of a waterpipe with a plurality of curved tubes.

Figure 1:
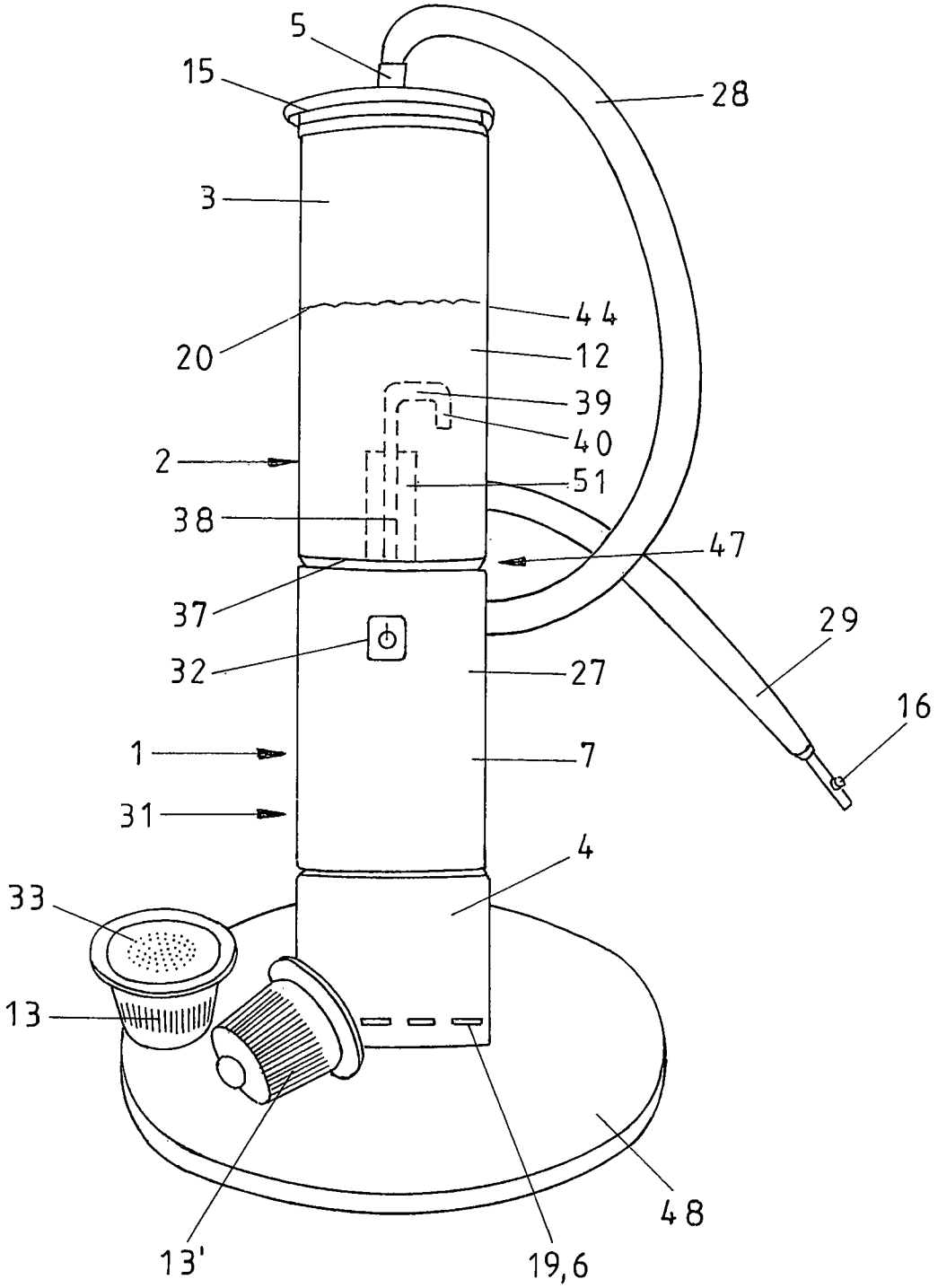
FIG. 1 shows a side view of a waterpipe.

The particular compactness of the waterpipe 1 with its elongated housing 2 and modular form is clear even from FIG. 1. The upper container 3 is upwardly closed by the lid 15. A suction hose 28, 29 is connected at its integral end to the connection nozzle 5 of the lid 15 and is provided at the other end with a replaceable mouthpiece 16. It is conceivable for a plurality of suction hoses 28, 29 to be connected. The water level of the water or liquid medium held in the container 3 is designated by 20, as it is advisable for the container 3 to be only partially filled. Heating chamber 31 and battery, as well as the control unit, are covered by a casing 27, which, among many other details, essentially characterises the design of such a waterpipe. The on-, off- or standby-switch for operating the shisha is designated 32. Two capsules containing smoking medium, each with perforations 33, are designated 13, 13'. The air inlet 6 is in the form of a plurality of air slits 19.

Figure 2:
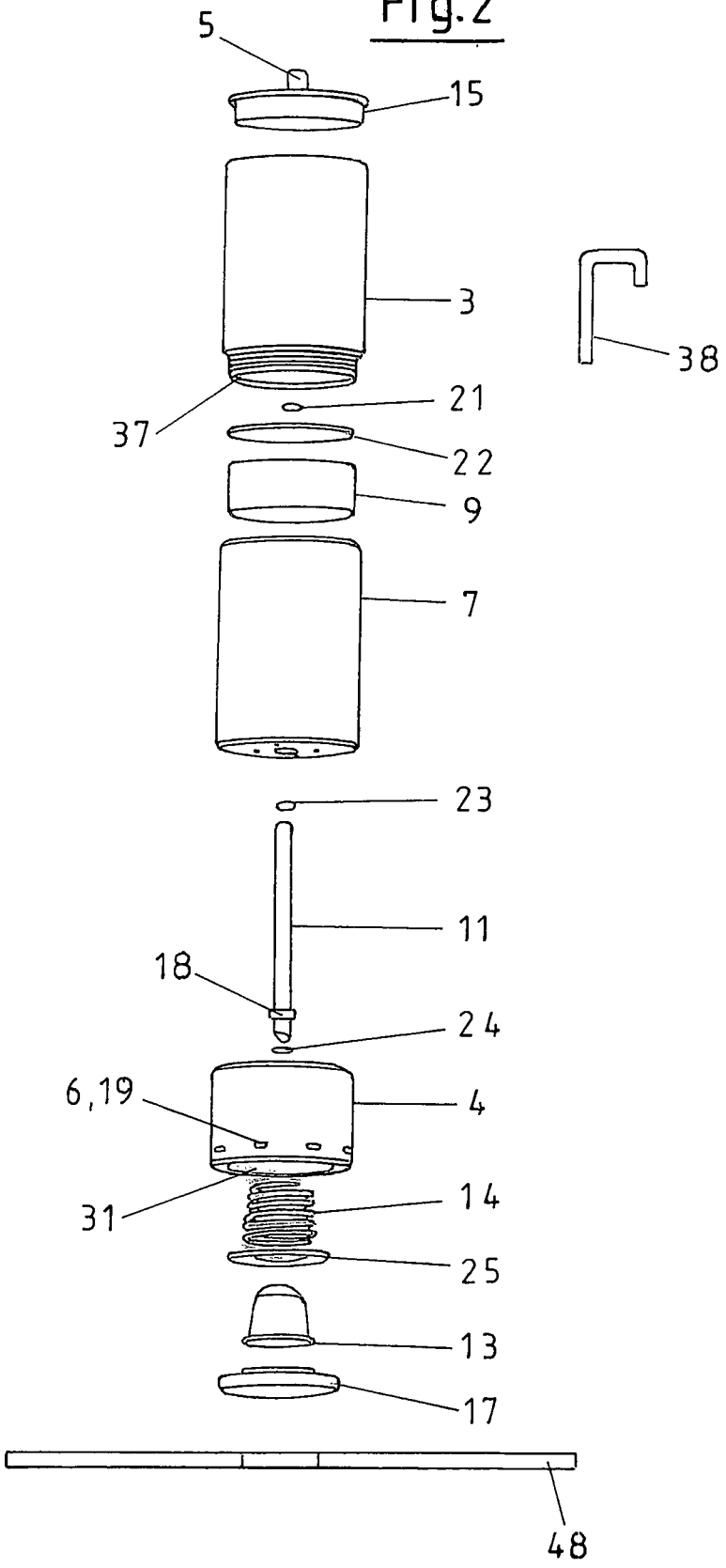
FIG. 2 shows an exploded view of the waterpipe according to FIG. 1.

FIG. 2 then shows, in an exploded view, a shisha or waterpipe 1 according to the invention. Air is drawn by the operator from the exterior, through the air inlet indicated by the reference numeral 6, into the heating chamber 31 in the lower container 4, where smoking medium is held in a replaceable capsule 13. A heating coil 14 is provided in the lower container 4 as heating medium, the conical form of which matches that of the capsule 13 or vice versa. A form of adapter disc is designated 25 and ensures correct fixation of the capsule 13. The lower container 4 communicates via the suction tube 11 with the container 3, which in turn is closed off at the top by the lid 15 and has a suction port 5 for a hose 28 with a mouthpiece 16 at the other end. The wall of the container 3 that serves as a tank is preferably made of acrylic glass. Lid 15, casing 27 and heating chamber 4 or the wall thereof, on the other hand, are preferably made of brushed or blasted stainless steel, aluminium or ceramic material. The suction tube 11 ensures that the mixture of air and smoking medium can pass from the lower container 4 into the container 3. The closure unit 10, which is described in more detail below, serves for additional sealing or separation. A sealing ring 21 ensures the necessary connection of the closure unit 10 to the suction tube 11. The washer 22, the Teflon washers 23 and 24, have the same function. They ensure the sealing of the suction tube 11 in the lower container 4 and on the other hand with respect to the battery 8 or its chamber. A measuring, regulating and/or control unit is designated 9, which, for example in interaction with a sensor, serves to monitor, control and/or regulate the heating function of the heating chamber 31. The control unit is accommodated in the middle container 7.

Figure 3:
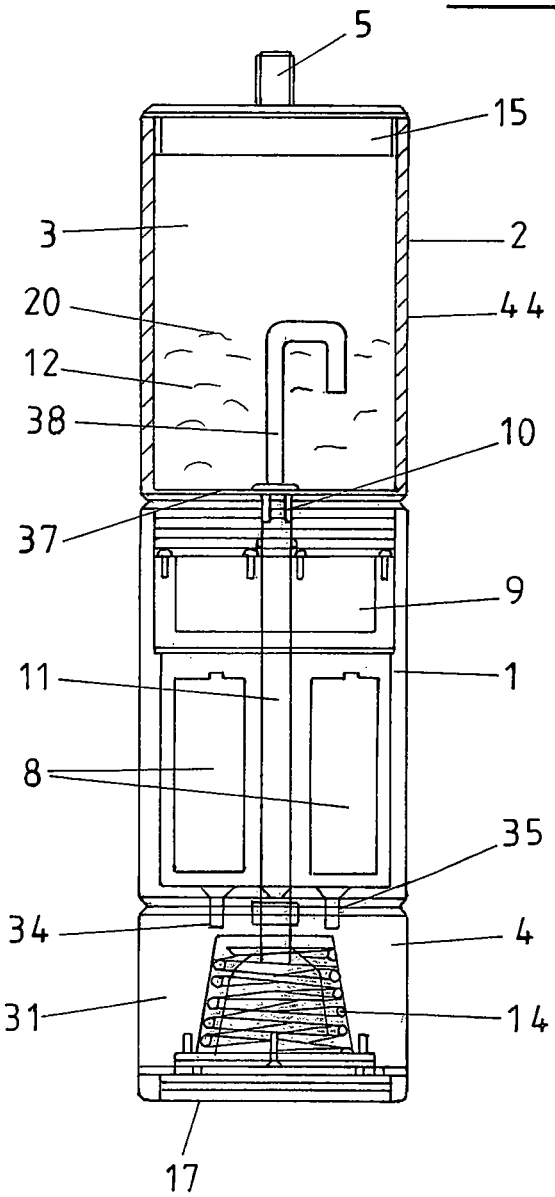
FIG. 3 shows a longitudinal section through the waterpipe.

In FIG. 3, the switch that operates the electronic parts is designated 32 and the liquid medium that partially fills the upper container 3 is designated 12. The water surface is designated 20. The end piece of the suction tube 11 that serves as the closure unit 10 is designated 38. The lower end of the suction tube 11, which extends into the lower container 4, is designated 18. The closure plate 17 ensures that the capsule 13 is pressed into the heating coil 14 and then fixed on or in the lower container 4. The baseplate, designated 48, improves the stability of the overall waterpipe 1, with additional functions that are explained further below. FIG. 3 shows a longitudinal section through the waterpipe 1 according to the invention, the upper container 3 of which is filled with water or another liquid medium up to the water level 20. The suction tube 38 inserted into the base 37 in the suction tube ending there is clearly visible here. FIG. 3 further shows the longitudinal section with the electrical shaft with the measuring, regulating and/or control unit 9 as well as the suction tube 11, which is guided centrally through the batteries 8 and finally ends in the heating chamber 31. If a capsule 13 is now inserted into the heating chamber 31, the lower end 18 of the suction tube 11 penetrates the capsule 13, releasing the gas mixture. The capsule 13 is fixed in the heating chamber 31 by the baseplate 17, the air supply is ensured by the air inlets 6 or slots 19 in the heating chamber 31.

The receptacle for the capsule 13 is designated 34. This heatable receptacle 34 for the capsule 13, with its walls 35 of approx. 2 mm thickness, has a taper, capsule 13 and receptacle 34 are formed so as to correspond to each other. The capsule 13 sits tightly in the receptacle 34.

FIG. 4 shows, in an enlarged scale, the end piece 38 of the suction tube 11. This end piece 38 extends into the upper container 3 up to about the middle 44 thereof, as FIG. 3 again makes clear. This end piece 38 is characterised by a free end that forms a bend 39. This bent end piece 38 prevents the liquid medium 12 from entering the suction tube 11. By actuating the hose 28 or 29 of the waterpipe 1, a reduced pressure is created in the upper part of the upper container 3. The smoke present in the suction tube 11 and in the bent end piece 38 can now escape via the free part 45 and mix with the liquid medium 12. FIG. 4 shows that the curved end piece 38 has a particular form of bend, namely the free end 40 of the end piece 38 is first bent at a right angle, with the resulting part 41 extending parallel to the water surface 20. Beyond the aid to turning 42, there is a further bend, so that a free part 45 is created, which points towards the base 37 of the upper container 3.

The vertical part 43 of the bent end piece 38 leads to approximately the middle 44 of the upper container 3, so that the horizontal or parallel part 41 usually lies just above the water surface 20.

In FIG. 1, 47 indicates that a click fastening is present between the upper container 3 and the middle container 7, FIG. 3 showing in particular that a twist closure may also be used at this point.

It has already been mentioned that a baseplate 48 can be used to improve the stability of the waterpipe 1. This is indicated in FIG. 2. In accordance with the present invention, this baseplate 48 has a particular form, because, as shown in FIG. 5, it has a lower rim 49, i.e. as it were a foot, which makes it possible to keep the actual plate at a spacing from the ground. This lower rim 49 may of course also extend in a star shape under the base of the actual baseplate 48, though the configuration shown here is particularly advantageous. A closure plate 17' is to be arranged in the recess 50 provided in the centre of the baseplate 48, which fixes the capsule 13 arranged above it in the heating chamber 31. If, after use, the capsule is pushed out of the heating chamber 31 by means of the suction tube 11, the closure plate 17' is pushed out of the recess 50 at the same time, so that the capsule 13 falls into the cavity under the actual baseplate 48. It can initially remain there, to cool down, or one lifts up the waterpipe 1 and places a new capsule 13 on the closure plate 17' and inserts this into the heating chamber 31, as shown in FIG. 3.

It has been further pointed out above that the upper container 3 is expediently made of acrylic glass or a similar transparent material, in which case the colouration of the curved end piece 38 is easy to see. This curved end piece 38 is intended to indicate by its colouration the flavour of the inserted capsule, so that the user can easily and clearly see what smoking pleasure awaits him. If, for any reason, a different material, which is not transparent, is used for the upper container 3, as indicated in FIG. 1, viewing slits 51 will expediently ensure that the colouration of the curved end piece 38 can be easily seen.

Finally, FIG. 6 shows an outline of a waterpipe with a plurality of curved end pieces 38, 38', which in this exemplary embodiment are arranged opposite each other.

The invention claimed is:

1. A waterpipe comprising a multi-part housing for smoking accessories, an electronic system and a liquid medium, wherein a housing part that holds the liquid medium has at least one suction port and is connected, via a suction tube passing through a housing part that holds the electronic system, to the housing part that holds a heating chamber and to a capsule that holds a smoking medium, and wherein the suction tube has a closure unit in a region of the transition from the housing part having the electronic system to the housing part that holds the liquid medium, wherein the closure unit is formed as an end piece of the suction tube that is bent into a U-shape.

2. The waterpipe according to claim 1, wherein the suction tube is formed with the bend reaching to just below the water surface.

3. The waterpipe according to claim 1, wherein the end piece is releasably connected to the suction tube that ends in the region of the base of the housing part that holds the liquid medium.

4. The waterpipe according to claim 1, wherein the free end of the end piece is bent first at right angles parallel to the water surface and then again at a right angle towards the base of the housing part that holds the liquid medium.

5. The waterpipe according to claim 4, wherein the part of the end piece extending parallel to the water surface has an aid to turning.

6. The waterpipe according to claim 4, wherein the vertical part of the end piece reaches approximately as far as the center of the housing part that holds the liquid medium and the free part that points towards the base of the housing part that holds the liquid medium has up to one third of the overall length of the end piece.

7. The waterpipe according to claim 4, wherein a sealing ring is arranged between the base of the housing part that holds the medium and the upper edge of the housing part that holds the electronic system.

8. The waterpipe according to claim 1, wherein the housing part that holds the liquid medium and the housing part that holds the electronic system are formed with a click fastening.

9. The waterpipe according to claim 1, wherein the housing part that holds the heating chamber is equipped with a base plate, which has a significantly larger diameter than the housing part that holds the heating chamber, preferably twice as large a diameter.

10. The waterpipe according to claim 1, wherein the base plate has a lower edge that serves as a standing aid and a recess in the centre, which is dimensioned to allow passage of the capsule in both directions, and is equipped with a closure plate that for insertion from below.

11. The waterpipe according to claim 1, wherein the end piece that is bent into a U-shape has a colouration that indicates a particular smoking medium or a capsule that holds that smoking medium and the housing part that holds the liquid medium consists of transparent material or has corresponding viewing slits.

12. The waterpipe according to claim 1, wherein the closure unit comprises a plurality of end pieces of the suction tube that are bent into a U-shape.

* * * * *